US007407469B2

(12) United States Patent
Lockhart

(10) Patent No.: US 7,407,469 B2
(45) Date of Patent: Aug. 5, 2008

(54) EXPANDABLE FOLDER

(76) Inventor: William E. Lockhart, deceased, late of Dallas TX (US); by Doris L. Lockhart, legal representative, 9610 Skillman, Dallas, TX (US) 75243

( * ) Notice: Subject to any disclaimer, the term of this patent is extended or adjusted under 35 U.S.C. 154(b) by 0 days.

(21) Appl. No.: 11/626,003

(22) Filed: Jan. 23, 2007

(65) Prior Publication Data

US 2007/0215679 A1 Sep. 20, 2007

Related U.S. Application Data

(62) Division of application No. 10/693,676, filed on Oct. 24, 2003, now Pat. No. 7,185,800.

(51) Int. Cl.
*B31B 1/26* (2006.01)

(52) U.S. Cl. ..... 493/243; 493/162; 493/245; 493/918; 229/67.3; 229/928

(58) Field of Classification Search ..... 493/162, 493/183, 231, 243, 245, 356, 476, 918, 947; 439/947; 229/67.3, 67.4, 928; 40/359
See application file for complete search history.

(56) References Cited

U.S. PATENT DOCUMENTS 646,638 A * 4/1900 Cutler ..... 229/75
1,042,488 A * 10/1912 Shaffer ..... 229/67.3
1,194,440 A * 8/1916 Swortfiguer ..... 229/67.3
1,478,248 A * 12/1923 Papparodis ..... 229/84
3,114,492 A * 12/1963 Engstrom ..... 206/425
4,109,850 A 8/1978 Meenan et al.
4,174,041 A * 11/1979 Turner ..... 229/229
5,921,463 A * 7/1999 Boyle et al. ..... 229/72
6,354,486 B1 * 3/2002 Ho ..... 229/67.3
6,461,070 B2 10/2002 Rew
2006/0016862 A1 * 1/2006 Makofsky ..... 229/67.3
2006/0054669 A1 3/2006 Hsieh

* cited by examiner

*Primary Examiner*—Hemant M Desai
(74) *Attorney, Agent, or Firm*—Thompson & Gustavson, L.L.P.

(57) ABSTRACT

An expandable folder (10) is disclosed for holding reports. The folder (10) is formed of a single sheet of material (12). The folder (10) includes a back (14), a front (20), two sides (16, 18) and a flap (22). The sides (16, 18) are folded inwardly and the front (20) is folded upwardly to form a pocket. Tabs (68, 70) on the front fit into slots (58, 60) in the sides (16, 18) to hold the folder together. Two label sections (label section (82) and back (14)) are provided to allow the folder to be marked with identifying information.

13 Claims, 3 Drawing Sheets

EXPANDABLE FOLDER

CROSS-REFERENCE TO RELATED APPLICATIONS

This application is a divisional of U.S. patent application Ser. No. 10/693,676, filed Oct. 24, 2003, now U.S. Pat. No. 7,185,800, issued on Mar. 6, 2007.

TECHNICAL FIELD

This invention relates to a professional looking storage folder for filing important legal and professional work documents, such as wills, tax returns and quarterly financial statements and reports, and in particular to a folder that can expand to accommodate multiple documents, taxpayer records, etc. of archival importance.

BACKGROUND OF THE INVENTION

Tax preparers and accountants will often produce reports for a client to advise them of their current financial condition. It is important to present these reports to clients in a professional and elegant manner to comport with the significance of the financial information. Thus, an attractive and professional appearing report folder in which to present a report is desired.

Quite often, reports will be presented on a quarterly basis, summarizing financials for a given quarter of the year. It is desirable to collect the four quarterly reports for a given year in one folder to provide a complete record for the year. It is also desirable to provide identification on the folder's front and edge to note the year, assuming that it will be placed on a shelf or in a file drawer with previous years reports, in order to distinguish one year from another.

A need exists to provide an elegant, professional looking report folder, particularly one that can hold the four quarterly reports for a given year yet provide fast, easy retrieval of folder contents in future years.

SUMMARY OF THE INVENTION

In accordance with one aspect of the present invention, an expandable folder is provided, comprising a single, integral sheet of material including a back having a lower edge, an upper edge, and first and second side edges, a first side connected to the first side edge of said back by a first expanding side section having first, second and third side fold lines, a second side connected to the second side edge of said back by a second expanding side section having first, second and third side fold lines, a front connected to the lower edge of said back by a expanding lower section having first, second and third lower fold lines, the front having a cover portion and a fold over portion, a flap connected to said upper edge of said back by an expanding upper section having first, second, third and fourth upper fold lines, wherein the fold over portion of said front has a first tab and a second tab, the first side has a slot to receive said first tab, the second side has a slot to receive said second tab, and the cover portion of said front has a slot for receiving said flap.

BRIEF DESCRIPTION OF THE DRAWINGS

A more complete understanding of the invention and its advantages will be apparent from the following Detailed Description when taken in conjunction with the accompanying Drawings, in which.

DETAILED DESCRIPTION

Figure 1:
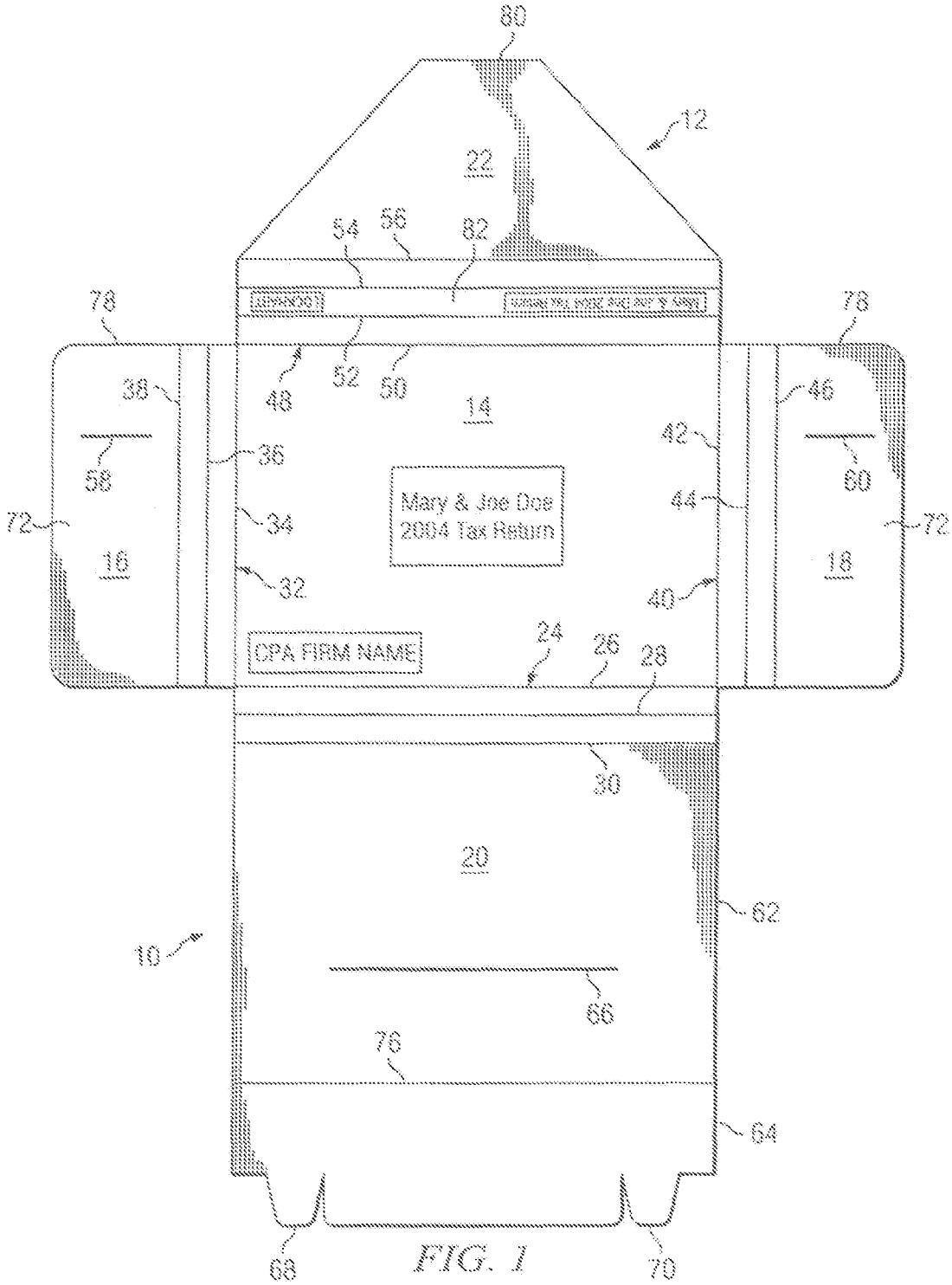
FIG. 1 is a plan view of an expandable folder forming a first embodiment of the present invention.

With reference now the Figures, wherein like reference characters designate like or corresponding parts throughout the several views, an expandable folder 10 forming a first embodiment of the present invention is disclosed. The expandable folder 10 is designed to contain reports, particularly quarterly reports, and can expand to accommodate an increasing thickness of the reports, as will be described here after. Further, the expandable folder 10 can be assembled without the use of glue, or other separate fasteners, and with no special tools.

With reference now to FIG. 1, the expandable folder 10 can be seen to be formed by a single integral sheet of material 12. The material 12 is preferably heavy paper, such as 130 pounds stock. The material 12 is formed into a back 14, a first side 16, a second side 18, a front 20 and a flap 22. The front 20 is connected to a lower edge 24 of the back 14 by an expanding bottom section of the front 20 including three fold lines 26, 28 and 30. The first side is connected to a first side edge 32 of the back 14 by an expanding side section including three side fold lines 34, 36 and 38. The second side 18 is connected to a second side edge 40 of the back 14 by an expanding side section including three fold lines 42, 44 and 46. The flap 22 is connected to a top edge 48 of the back 14 by an expanding top section including four fold lines 50, 52, 54 and 56.

The first side 16 has a tab slot 58 formed therein. The second side 18 has a tab slot 60 formed therein. The front 20 is formed into two sections, a cover portion 62 and a fold over portion 64 separated by a fold line 76. The cover portion 62 has a flap receiving slot 66 therein. The fold over portion 64 is defined by having tapered tabs 68 and 70.

Figure 2A:
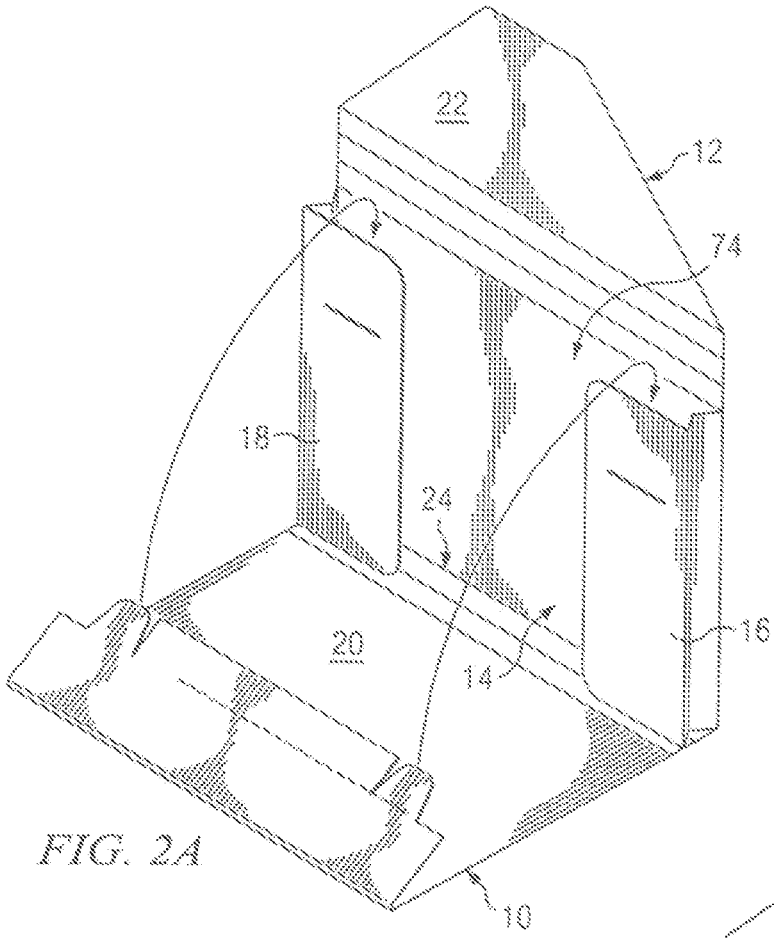
FIG. 2A is a perspective view of the expandable folder partially assembled with the sides folded inward.
Figure 2B:
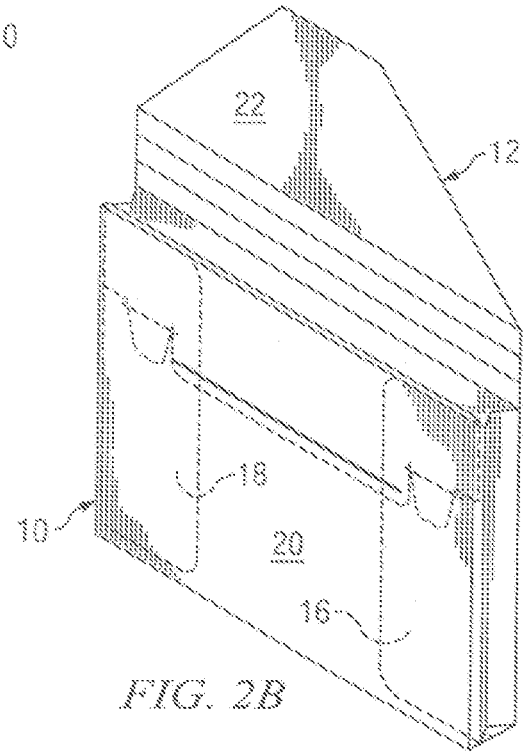
FIG. 2B is a perspective view of the expandable folder assembled with the flap open to receive documents.
Figure 2C:
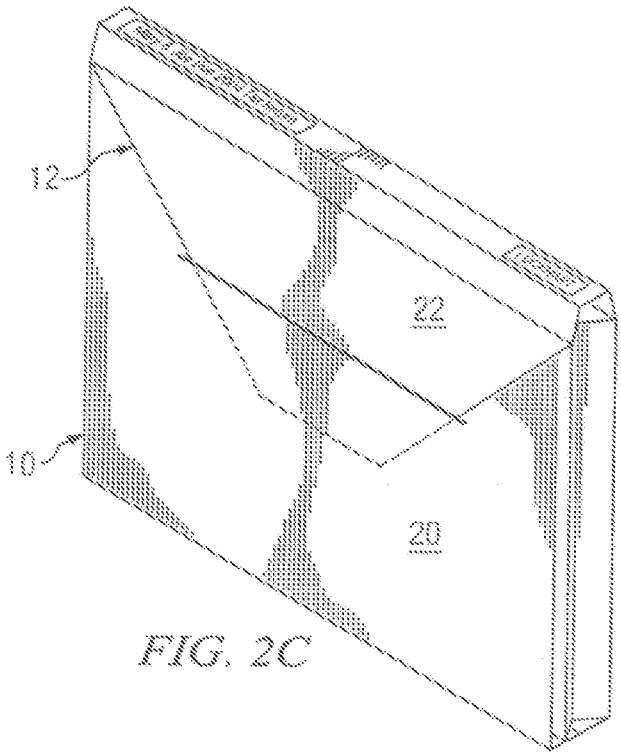
FIG. 2C is a perspective view of the expandable folder assembled with the flap closed.
Figure 2D:
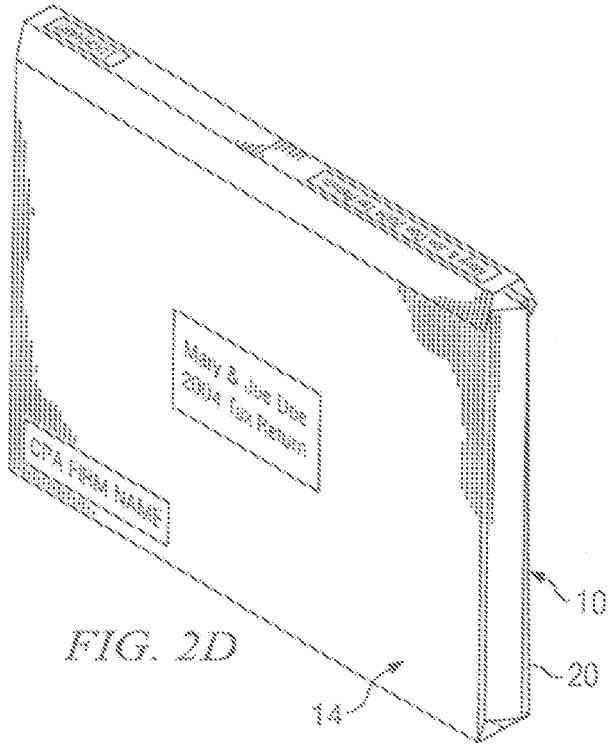
FIG. 2D is perspective view of the expandable assembled showing the labeling.

With reference to the Figures, The expandable folder 10 can be assembled by folding in the first and second sides 16 and 18, as seen in FIG. 2A, so that the surfaces 72 of the first and second sides 16 and 18 face away from the inner surface 74 of the back 14. The front 20 is then folded about the fold lines 26, 28 and 30 so that the fold line 76 separating the cover portion 62 and fold over portion 64 is proximate the upper edges 78 of the first and second sides 16 and 18. The fold over portion 64 is then folded about the fold line 76 so that the tabs 68 and 70 are positioned between the first and second sides 16 and 18 and the back 14, as seen in FIG. 2B. The tab 68 is slid into a slot 58 and the tab 70 is slid into slot 60. The tabs 68 and 70 wedge into slots 58 and 60 due to their tapered wedge shape. By using the tabs 68 and 70 and slots 58 and 60, the first and second sides 16 and 18 are prevented from opening outward and the front 20 is held in position adjacent to the back 14 to form a pocket to receive the reports.

After the reports have been inserted within the expandable folder 10, the flap 22 can be folded over the reports and the end 80 of the flap inserted into the flap slot 66 in the front 20 to close the folder 10 over the reports. One advantage of the design is the fact that the fold over portion 64 covers the flap slot 66 when the folder 10 is assembled such that when the end 80 of the flap is inserted into the flap slot 66, the end 80 is sandwiched between the fold over portion 64 and cover portion 62 so that is does not catch on or interfere with the reports inside the folder 10. The use of the fold lines 26-30, 34-38, 42-46 and 50-56 permits the front 20 and back 14 to be spaced apart the proper distance to hold the reports and allows the expandable folder 10 to expand to the thickness required. The use of fold lines 50, 52, 54 and 56 define a label section 82 between the fold lines 52 and 54 which can be marked with labels identifying the contents of the expandable folder 10. By use of the four fold lines 50, 52, 54 and 56, the label section 82 will remain generally parallel the end of the expandable folder 10 as the folder is expanded in thickness to allow the label section 82 to be viewed easily.

In one expandable folder constructed in accordance with the teachings of the present invention, the folder was designed to accommodate a total thickness of reports therein of 1¼ inches. The fold lines 26, 28 and 30, fold lines 34, 36 and 38, and fold lines 42, 44 and 46 were each separated by ⅝ inches. The fold lines 50 and 52 and fold lines 54 and 56 were separated by 5/16 inches. The fold lines 52 and 54 were separated by ⅝ inches. The back 14 and cover portion 62 (excluding the bottom section with fold lines 26-30) were 9⅝ inches high and 11⅝ inches wide. The flap 22 was four inches high (excluding the top section with fold lines 50-56). The flap slot 66 was 4¾ inches wide. The tab slots were 1¼ inches wide and the first and second sides 16 and 18 were 2½ inches wide (excluding the side sections with fold lines 34-38 and 42-46). The distance from fold line 76 to flap slot 66 is 2 13/16 inches.

As can be appreciated, the expandable folder 10 can be assembled without tools or equipment. No glue or other fasteners are required to assemble the folder 10. In spite of the lack of glue or fasteners, the expandable folder 10 securely holds the reports in an attractive and presentable manner. The expandable folder 10 will readily fit on a shelf or in a drawer, with the label section 82 readily visible to indicate to the user the contents of the folder 10 and the firm name of the preparer. The exposed surface of the back 14 can also be imprinted with the preparer's firm name and personalized with a label adhered by adhesive to show the recipient's name, contents, year, etc. Preferably, the fold lines are knife cut and not scored. Clearly, if glue or other fasteners are desired, the expandable folder 10 can incorporate them.

While a single embodiment of the present invention has been illustrated in the accompanying drawings and described in the foregoing detailed description, it will be understood that the invention is not limited to the embodiment disclosed, but is capable of numerous rearrangements, modifications and substitutions of parts and elements without departing the scope and spirit of the invention.

The invention claimed is:

1. A method for assembling an expandable folder, comprising the steps of:

folding a first side of a single, integral sheet of material over a back, the back having a lower edge, an upper edge, and first and second side edges, the back having a width defined between said first and second side edges and the first side connected to the first side edge of said back by first, second and third side fold lines and the first side having a slot;

folding a second side over the back, the second side connected to the second side edge of said back by first, second and third side fold lines and the second side having a slot;

folding a front connected to the lower edge of said back by first, second and third lower fold lines toward the back, the front having a cover portion and a fold over portion, the front having a width corresponding to width of the back, the fold over portion of said front having a first tab and a second tab and the cover portion having a slot, wherein the first and second tabs have an end;

folding the fold over portion over the first and second sides and inserting the first tab in the slot in the first side, and inserting the second tab in the slot in the second side and thus positioning the ends of the first and second tabs between the first and second sides and the cover portion and positioning the fold over portion between the back and the first and second sides; and folding a flap connected to said upper edge of said back by first, second, third and fourth upper fold lines over the front and inserting a portion of the flap into the slot in the cover portion of said front.

2. The method for assembling an expandable folder of claim 1 further comprising the step of using no glue or fastener to form the folder.

3. The method for assembling an expandable folder of claim 1 further comprising the step of forming a label section between the second and third fold lines of the flap.

4. The method for assembling an expandable folder of claim 1 wherein the first and second sides have an upper edge, the upper edge forming a continuation of the first fold line of the flap, the foldover portion and cover portion joined at a first fold line, further comprising the step of folding over the foldover portion over the upper edges of the first and second sides at the first fold line.

5. The method for assembling an expandable folder of claim 1 further comprising the step of forming no additional fold lines between the back and first side, back and second side, front and back and back and flap.

6. The method for assembling an expandable folder of claim 1 further comprising the step of exposing no portion of the first and second tabs and slots.

7. The method for assembling an expandable folder of claim 1 further comprising the step of only forming a single slot in the first and second sides.

8. The method for assembling an expandable folder of claim 1 wherein the flap has an end, the end received in the slot of the cover portion, further comprising the step of positioning at least a portion of the end of the flap between the cover portion and first and second sides.

9. The method for assembling an expandable folder of claim 1 further comprising the step of placing the ends in the slots of the first and second sides with the ends between the first and second sides and the front to prevent objects in the folder from inadvertently contacting the ends and forcing the ends out of the slots.

10. The method for assembling an expandable folder of claim 1 further comprising the step of forming no additional fold lines between the back and flap, the portion of the expanding top section between the second and third fold lines remaining generally perpendicular the front and back as the folder is expanded such that a label on said portion remains readable from the top of the folder.

11. The method for assembling an expandable folder of claim 1 further comprising the step of folding the cover portion and foldover portion over upper edges of the first and second sides whereby the first and second tabs do not move within the slots of the first and second sides as the folder expands.

12. The method for assembling an expandable folder of claim 1 further comprising the step of covering the slot in the cover portion with the foldover portion preventing the flap from contacting objects in the folder as the flap is inserted into the slot.

13. A method for assembling an expandable folder, comprising the steps of:

folding a first side of a single, integral material over a back, the back having a lower edge, an upper edge, and first and second side edges, the lower and upper edges being parallel and the first and second side edges being parallel, the back having a width defined between said first and second side edges, the first side connected to the first side edge of said back by a first expanding side section having only first, second and third side fold lines, the first side defining an upper edge forming a continuation of and parallel to the upper edge of the back, a lower edge forming a continuation of and parallel to the lower edge of the back and a side edge extending generally perpendicular to the upper and lower edges of the first side, the first side having a slot;

folding a second side over the back, the second side connected to the second side edge of said back by a second expanding side section having only first, second and third side fold lines, the second side defining an upper edge forming a continuation of and parallel to the upper edge of the back, a lower edge forming a continuation of and parallel to the lower edge of the back and a side edge extending generally perpendicular to the upper and lower edges of the second side, the second side having a slot;

folding a front connected to the lower edge of said back by an expanding bottom section including only first, second and third lower fold lines toward the back, the front having a cover portion and a fold over portion, the cover portion and fold over portion having first and second side edges forming a continuation of and parallel to the first and second side edges of the back, respectively, the cover portion of said front having a slot, the fold over portion of said front having a first tab and a second tab;

folding the fold over portion of the front over the upper edges of the first and second sides, and inserting the first tab in the slot in the first side, and inserting the second tab in the slot in the second side and thus positioning the fold over portion between the back and the first and second sides with the first and second tabs received in the slots in the first and second sides with no portion of the first and second tabs and slots exposed, wherein the first and second tabs have an end, the ends received in the slots of the first and second sides with the ends positioned between the first and second sides and the cover portion, the first and second tabs fixed within the slots of the first and second sides as the folder expands as the cover portion and the fold over portion of the front are folded over the upper edges of the first and second sides, wherein the fold over portion covers the slot in the cover portion; and folding a flap connected to said upper edge of said back by an expanding top section including only first, second, third and fourth upper fold lines over the front, the expanding top section having first and second side edges forming a continuation of the first and second side edges of the back respectively, the flap having first and second edges tapering from the expanding top section to an end of width less than the width of the back, the portion of the expanding top section between the second and third fold lines remaining generally perpendicular the front and back as the folder is expanded such that a label on said portion remains readable from the top of the folder.

* * * * *